US007992476B2

(12) United States Patent
Kaposi

(10) Patent No.: US 7,992,476 B2
(45) Date of Patent: Aug. 9, 2011

(54) FOOD CHOPPER

(75) Inventor: Sascha Kaposi, Tacoma, WA (US)

(73) Assignee: Progressive International Corporation, Kent, WA (US)

( * ) Notice: Subject to any disclaimer, the term of this patent is extended or adjusted under 35 U.S.C. 154(b) by 1093 days.

(21) Appl. No.: 11/424,765

(22) Filed: Jun. 16, 2006

(65) Prior Publication Data

US 2006/0218799 A1 Oct. 5, 2006

Related U.S. Application Data

(63) Continuation-in-part of application No. 11/033,944, filed on Jan. 11, 2005, now Pat. No. 7,191,691.

(60) Provisional application No. 60/623,582, filed on Oct. 29, 2004.

(51) Int. Cl.
*B26D 1/03* (2006.01)

(52) U.S. Cl. ..... 83/167; 83/435.15; 83/564; 83/932; 30/124; 99/537

(58) Field of Classification Search ..... 83/167, 83/466.1, 522.11, 564, 597, 599, 651.1, 697, 83/856–858, 932, 435.15, 435.16, 435.17, 83/435.18, 435.19; 30/124, 299; 99/467, 99/537, 543, 552–556, 559–564, 646 C, 567, 99/580; D7/381, 673, 674
See application file for complete search history.

(56) References Cited

U.S. PATENT DOCUMENTS

| | | | | |
|---|---|---|---|---|
| 662,588 | A | 11/1900 | Bloom | |
| 751,433 | A | 2/1904 | Kennedy et al. | |
| 809,952 | A | 1/1906 | Hoffa | |
| 928,019 | A | 7/1909 | Bartow | |
| 1,504,501 | A | 8/1924 | Pope | |
| 1,674,475 | A * | 6/1928 | Loomis | 99/508 |
| 2,004,858 | A * | 6/1935 | Farabough | 83/167 |
| 2,030,975 | A | 2/1936 | Fairchild | |
| 2,245,978 | A | 5/1940 | Hyland | |
| 2,309,814 | A | 2/1943 | Youngberg | |
| 2,645,262 | A * | 7/1953 | Marasco | 83/435.15 |
| 2,735,467 | A * | 2/1956 | Hellmich | 241/84.3 |
| 3,077,213 | A | 2/1963 | Germano | |
| 3,077,215 | A * | 2/1963 | Kentor | 83/158 |
| RE26,796 | E * | 2/1970 | Lamb | 426/482 |
| 3,997,072 | A | 12/1976 | Guth | |
| 4,095,339 | A | 6/1978 | Turner | |
| 4,212,431 | A | 7/1980 | Doyel | |
| 4,292,846 | A | 10/1981 | Barnett | |
| 4,300,429 | A * | 11/1981 | Brown et al. | 83/651.1 |
| 4,457,070 | A | 7/1984 | Reeves | |
| 4,557,053 | A | 12/1985 | Hadley, Jr. | |
| 4,574,479 | A | 3/1986 | Gramann | |
| 4,733,589 | A | 3/1988 | Wolff | |

(Continued)

FOREIGN PATENT DOCUMENTS

| | | |
|---|---|---|
| GB | 2286110 | 8/1995 |

(Continued)

*Primary Examiner* — Edward Landrum

(74) *Attorney, Agent, or Firm* — Black Lowe & Graham PLLC

(57) ABSTRACT

A food chopping or slicing device preferably includes three primary components, including a lid, a blade tray, and a food reservoir. A trimming blade secures to an edge of the device to cut overlength food items. In some embodiments, a reservoir bottom is removable and the device includes orthogonal volumetric markings.

9 Claims, 4 Drawing Sheets

U.S. PATENT DOCUMENTS

| | | | | | |
|---|---|---|---|---|---|
| 4,759,148 | A | | 7/1988 | Love | |
| 4,805,843 | A | | 2/1989 | Draper | |
| D331,687 | S | | 12/1992 | Pujol Gilbert | |
| 5,249,693 | A | | 10/1993 | Gillispie et al. | |
| 5,303,472 | A | * | 4/1994 | Mbanugo | 30/124 |
| 5,337,480 | A | * | 8/1994 | Codikow | 30/114 |
| 5,499,578 | A | | 3/1996 | Payne | |
| 5,516,038 | A | | 5/1996 | Zaccarini | |
| 5,692,424 | A | * | 12/1997 | Wallace | 83/167 |
| 5,937,525 | A | | 8/1999 | Chan | |
| 5,967,875 | A | | 10/1999 | Graef | |
| D447,391 | S | | 9/2001 | Bodum | |
| 6,293,445 | B1 | | 9/2001 | Miller | |
| 6,435,080 | B1 | * | 8/2002 | Zarlengo | 99/510 |
| 6,558,244 | B1 | * | 5/2003 | Nedelka | 452/149 |
| D485,328 | S | | 1/2004 | Jastrzembski | |
| 6,802,149 | B1 | | 10/2004 | Albanese, Jr. et al. | |
| 6,805,032 | B2 | | 10/2004 | Engdahl | |
| D499,615 | S | | 12/2004 | Nordgren | |
| D519,001 | S | | 4/2006 | So | |
| 7,444,909 | B2 | * | 11/2008 | Repac et al. | 83/167 |
| 2002/0003144 | A1 | | 1/2002 | Grimes | |
| 2003/0051345 | A1 | | 3/2003 | Yeung Louie et al. | |
| 2004/0055437 | A1 | | 3/2004 | Engdahl | |

FOREIGN PATENT DOCUMENTS

| | | |
|---|---|---|
| WO | 02064331 | 8/2002 |
| WO | 2005090029 | 9/2005 |

* cited by examiner

FIG.1
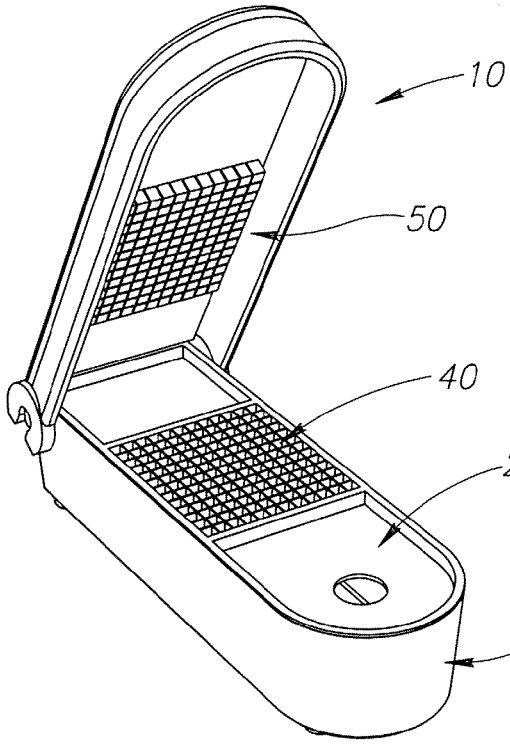
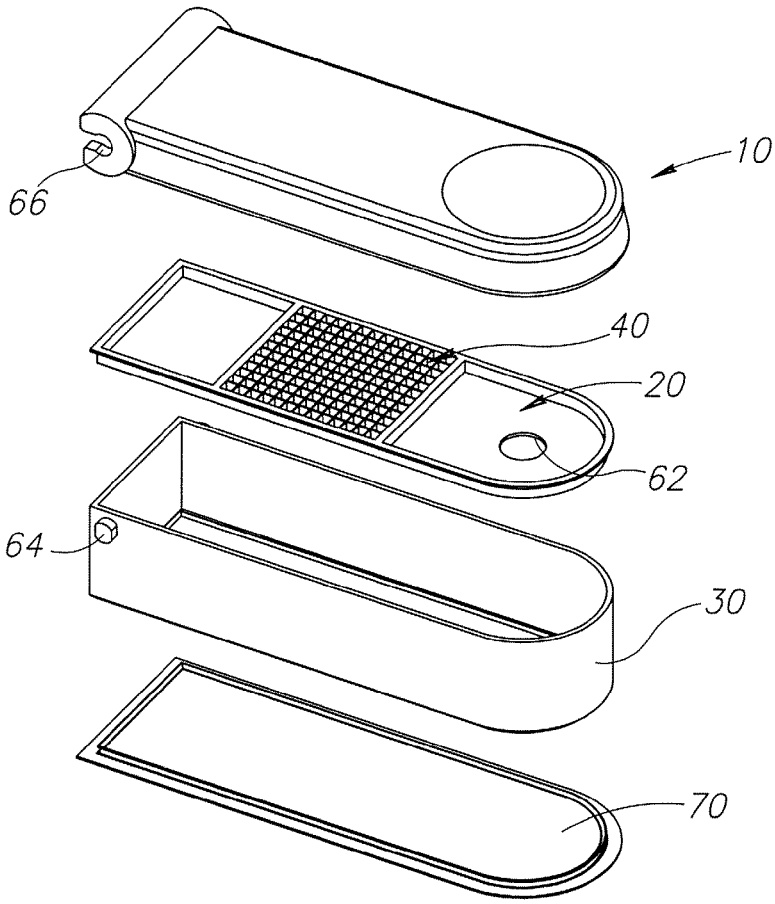
FIG.2

FOOD CHOPPER

This application is a continuation in part of U.S. application Ser. No. 11/033,944 filed Jan. 11, 2005, which claims the benefit of prior U.S. Provisional Application Ser. No. 60/623,582, filed Oct. 29, 2004.

FIELD OF THE INVENTION

This invention relates generally to food preparation devices, including devices for chopping or slicing onions, mushrooms, and the like.

BACKGROUND OF THE INVENTION

In preparing food, it is often desirable to prepare onions by slicing them in strips or chopping them into small pieces. Most commonly, this is done by using a knife. There are other specially-designed devices for chopping foods, but none are particularly well suited to chopping onions.

One exemplary food cutting device is used to cut potatoes for French fries, incorporating a sliding array of rectangular projections that can be pressed downward to push the potato through a grid of blades. This arrangement is common to all French fry cutters, which can also be used to cut other vegetables such as onions. In such devices, the blades and the projections are parallel to each other at all times. One problem with such devices is that there is no integrated reservoir to receive the sliced potatoes as they are pushed through the grid of blades.

There are also presently existing mushroom cutters, including a blade frame and pusher element that are pivotally connected to each other via an elongated handle. Unfortunately, the operation of the device pushes the food onto the countertop or work surface, limiting the amount of food that can be chopped and potentially mashing the food or resulting in an uneven slicing operation. Alternatively, the user must hold the device above the countertop with one hand, and use the other hand to receive the slices as they emerge from the device.

There is therefore a need for an improved food chopping or slicing device, including devices suitable for cutting mushrooms, onions, and the like.

BRIEF DESCRIPTION OF THE DRAWINGS

FIG. 1 is a perspective view of a preferred food chopper;

FIG. 2 is an exploded view of a preferred food chopper;

DETAILED DESCRIPTION OF THE PREFERRED EMBODIMENT

Figure 3:
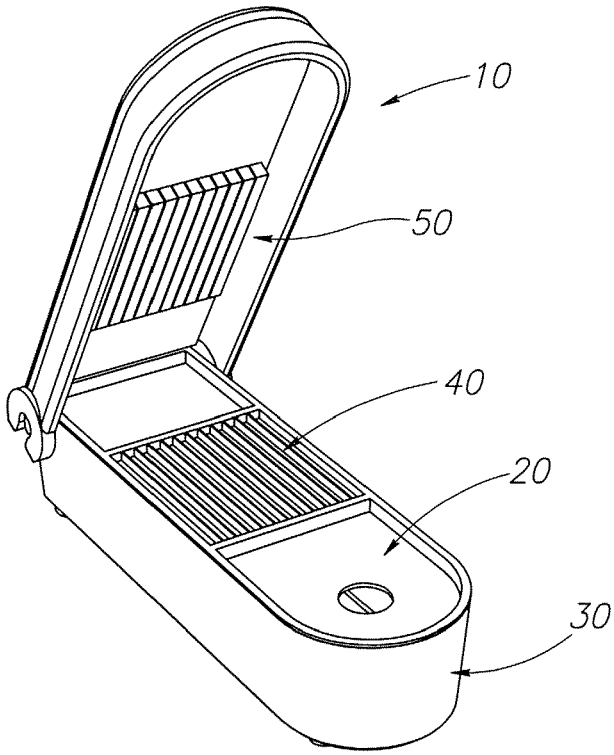
FIG. 3 is a perspective view of an alternate embodiment of a preferred food chopper.

A preferred food chopper is shown in FIG. 1, below. In the embodiment of FIG. 1, the food chopper includes three primary components, including a lid 10, a blade tray 20, and a food reservoir 30. The lid and the food reservoir are pivotally connected to one another, with the blade tray being removably mounted within an upper rim of the reservoir.

The lid is generally rectangular in shape, having squared corners at a first end that is pivotally connected to the reservoir and rounded corners at a second end opposite the first end. A downward-extending flange surrounds the peripheral edge of the lid, and is sized and shaped to snugly receive an outer surface of the reservoir within the flange when the lid is rotated downward against the reservoir.

The lid further includes a grid of projections 50 on the inner surface, extending downward in the same direction as the flange. The projections may take on any size or shape, as desired, and are ideally shaped to thoroughly push the food through the blades within the blade tray. As discussed further below, the blade tray includes a network of blades 40 configured at right angles and forming generally square openings. The projections on the lid are sized and located within the lid such that when the lid is closed, a projection fits within each of the blade openings.

The food reservoir, best seen in the exploded view of FIG. 2, is formed in substantially the same shape as the lid when viewed from the top. Thus, in the preferred form, it has a generally rectangular shape with two rounded corners. The reservoir includes a bottom and four sidewalls to form an interior rectangular cubic cavity. The depth of the reservoir may vary, and is preferably sized to hold a typical expected volume of onions, mushrooms, or other food ingredients that may be used in cooking.

The reservoir includes a boss 64 at opposing sides of the squared ends of the top of the rectangular reservoir. The bosses are configured to be received within a pair of bores 66 at opposite sides of the squared ends of the lid, forming the pivotal connection between the lid and the reservoir. Accordingly, the lid is able to rotate about the pivotal connection from an open position that is preferably at least about 90 degrees with respect to the blade tray to a closed position resting adjacent and substantially flush with the blade tray.

Figure 4:
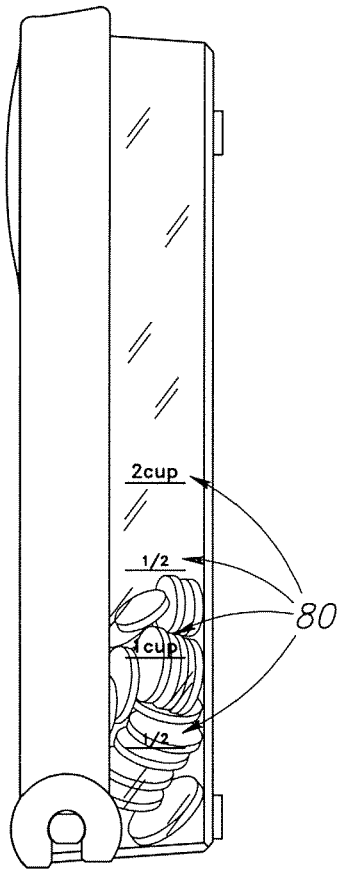
FIG. 4 is a side view of a preferred food chopper oriented on end.

In alternate embodiments of the invention, the reservoir also includes volumetric measurements on an inner or outer surface, as shown in FIG. 4. As discussed further below, the measurements enable the user to determine when he or she has chopped enough of the food ingredient, without the necessity of a further step of transferring the ingredient to an additional measuring cup.

In another alternate embodiment, the bores 66 on the lid are open adjacent the outer edge of the lid, as shown in FIG. 2, forming a C-shape. The C-shaped openings enable the lid to more readily be removed from the tray for cleaning.

The blade tray 20 is formed in the same shape as the lid and reservoir, such that in the preferred embodiment it comprises a rectangular shape with two rounded corners. A substantially square blade grid 40 is formed at a central location on the tray. Preferably, the tray is formed from plastic and the blade grid formed from stainless steel. The top edges of the blades within the grid are sharpened in order to slice through the foods that are being pushed through the blade grid from above.

At one end of the tray, in this case, the rounded end, a bore 62 is included to more easily enable the tray to be lifted from the reservoir and removed for cleaning and removal of the food within the reservoir.

The tray includes a flat base that transitions to a generally vertical peripheral wall, as best seen in FIG. 2. At the top of the wall, the tray includes a substantially horizontal peripheral flange. The wall and flange are sized and configured such that the wall is snugly received within the sidewalls of the reservoir, and the flange rests against a top rim of the reservoir. In this fashion, the flange enables the tray to rest securely atop the reservoir. Alternative arrangements are also possible, including for example an internal flange or shoulder within the reservoir. Likewise, the size and shape of the tray and other components may be varied, consistent with the invention.

Each of the lid, tray, and reservoir is preferably formed from plastic, except for the blades as noted above. In a preferred form, at least the reservoir is formed from clear plastic to enable the user to see the volume of food inside.

Figure 5:
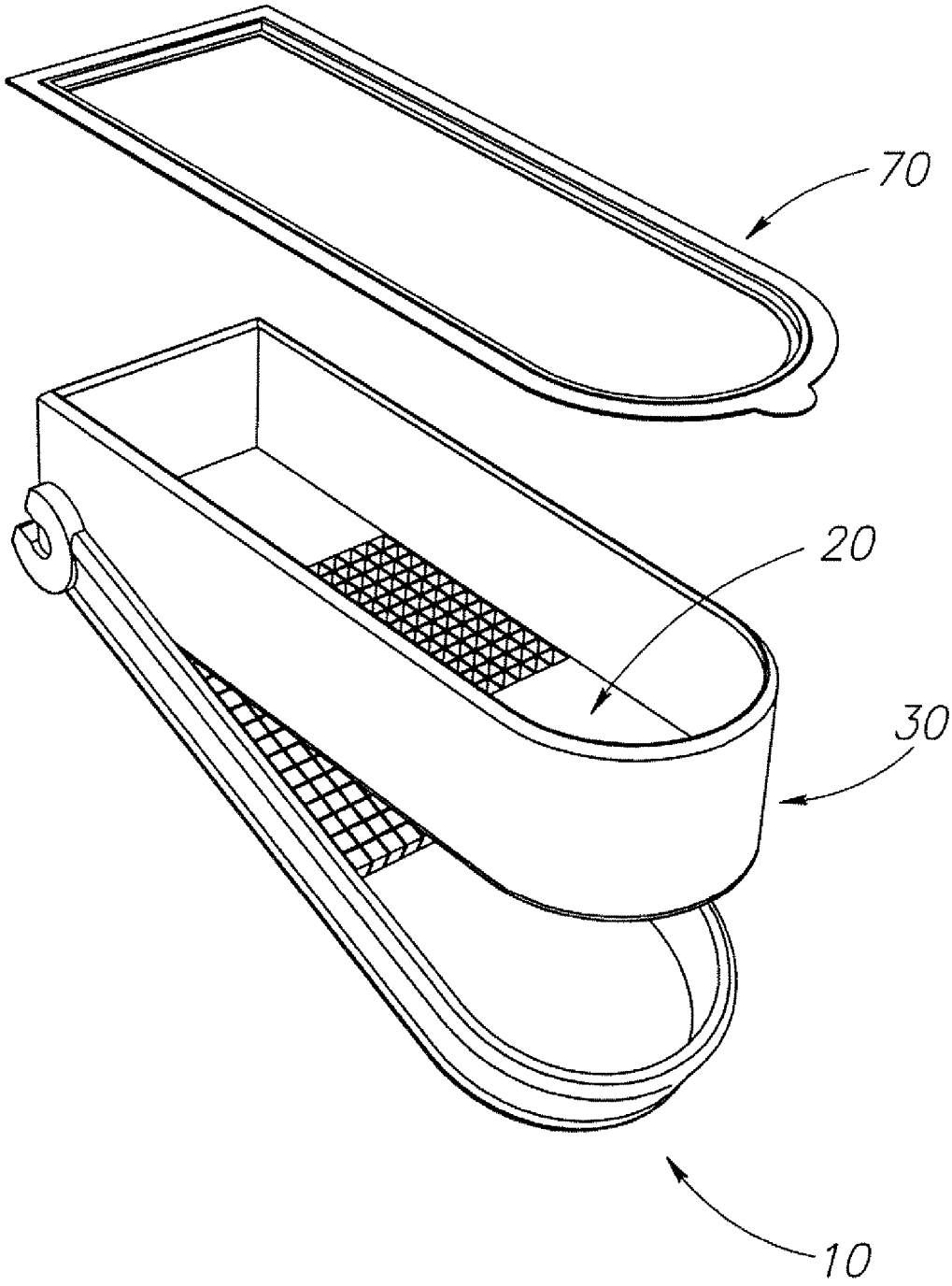
FIG. 5 is a partial exploded view of a preferred food chopper, oriented upside down.

The reservoir may optionally include non-skid feet attached to the bottom, as best seen in FIG. 4, formed from silicone or other suitable materials. In yet other embodiments, as best seen in FIGS. 2 and 5, the reservoir 30 may include a removable bottom section 70 that is preferably friction-fitted or snap-fitted into the reservoir 30. Thus, with the bottom section in place, food that is chopped with the device will be retained within the reservoir and can be readily carried to a pot or bowl. With the bottom removed, the chopper can be placed directly onto a plate, bowl, or other device to allow food to be chopped and dropped directly into the plate, bowl, or pan.

In some embodiments, a top surface of the lid includes a generally rounded convex shape adjacent the rounded end, as best seen in FIG. 2. This provides a better grip and more ergonomic surface for the user when chopping food within the device.

In use, the user places an onion (or other food item) atop the grid of blades while the lid is open. By pressing against the lid, causing pivotal and downward rotation of the lid, the grid of projections is pressed against the onion. In turn, the onion is pressed against the grid of blades, urging it through the blade openings and producing chopped onion sections having a cross-sectional shape that is the same as the blade openings. Once the lid approaches the blade grid, the projections press through the grid to clear any remaining food from the grid.

When the reservoir is full, or the chopping is completed, the tray is removed from the top of the reservoir. The chopped onion or other food may then be readily removed from the reservoir. The entire device can also be easily cleaned by separating the tray from the reservoir and, if desired, also removing the lid.

An alternate form of the food chopping device is shown in FIG. 3. In this form, the device includes the same primary components of a lid, tray, and reservoir. The primary difference is that the grid of blades comprises a plurality of elongated parallel blades, rather than two pluralities of blades arranged at right angles. The grid of projections extending from the lid is similarly configured as a series of adjacent parallel bars that will fit snugly through the grid of blades. In addition, the reservoir is somewhat deeper and the rectangular shape is somewhat shorter, with the length and width of the rectangle being closer in length to one another.

As shown in FIG. 4, the food chopping device may include measurement markings 80. In the preferred form, the measurement markings 80 are oriented vertically, so that the words are read properly with the device tipped up on end, or rotated 90 degrees. As food is chopped with the device, it will form a mound shape, making it difficult to tell with certainty the amount of food that has been chopped, even if there are measurement markings oriented horizontally. This is especially true for devices that have a base of a width or length that is substantially greater than the height. In order to determine the amount of food that has been chopped, the device is rotated 90 degrees, allowing the food to settle to the hinged end. The device may be shaken gently to allow the food to settle and form a substantially horizontal top. At that point, the user can determine the amount of chopped onions or other food ingredients by looking at the measurement markings associated with the top of the ingredient level through the clear plastic food reservoir. Ideally, the size of the reservoir is sufficient to accommodate a typically expected volume of food. In the example shown in FIG. 4, there are markings in half-cup increments up to the 2-cup level, with the reservoir itself exceeding 2 cups in volume.

As shown in FIG. 4, the volumetric markings 80 are placed on a sidewall of the reservoir. In alternate embodiments, the markings may be placed on the bottom 70, the lid 10, or in other locations that are visible and enable a determination of the volume of articles within the device.

This alternate embodiment is particularly well suited for use in slicing mushrooms or other foods intended to be sliced rather than chopped into smaller bits. The device is used in the same manner, by placing a mushroom or other food item atop the grid of blades and rotating the lid toward the tray, urging the food through the grid of blades.

Figure 6:
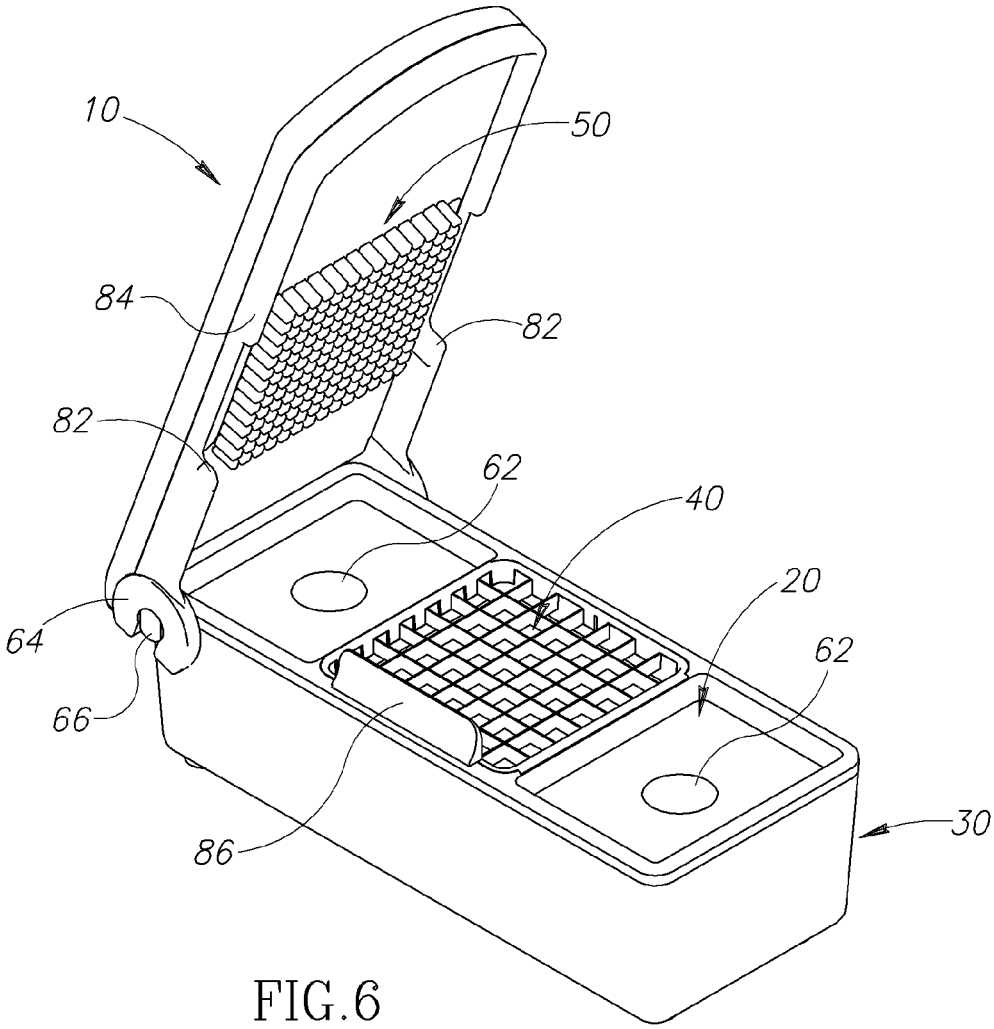
FIG. 6 is a perspective view of an alternative embodiment of a food chopper.

Referring to FIG. 6, in an alternative embodiment of the invention, the lid 10 and tray 20 are modified to facilitate chopping elongate items such as celery. The lid 10 includes a front rim 84 and a rear rim 82, with an intermediate section between the front rim and rear rim that is recessed or cutaway to form an opening. The opening is located near the blades 40 when the lid 10 is closed. A trimming blade 86 secures to an edge of the tray 20 or reservoir 30 near the blades 40. In use, an end portion of a large item such as celery is placed over the blades 40 with a portion of the item extending over the trimming blade 86. As the lid 10 is brought down over the item, the lid urges the food item against the trimming blade so that the trimming blade 86 cuts off the end of the item and the projections 50 force the end of the item through the blades 40. The apparatus of FIG. 6 therefore eliminates the need to cut an item into lengths before dicing with the blades 40. The lid 10 may include cutaway portions on either side or both sides. In this manner the device functions equally well regardless of how the user orients the tray 20 and with its trimming blade 86. Likewise, the trimmer blade may alternately be attached to the lid and oriented in a downward fashion to cut the item as the lid is pivoted downward. In such a configuration, the device may include a recessed portion of the blade tray, or the downwardly extending blade may be configured so that it abuts an outer sidewall of the reservoir when the lid is closed.

Figure 7:
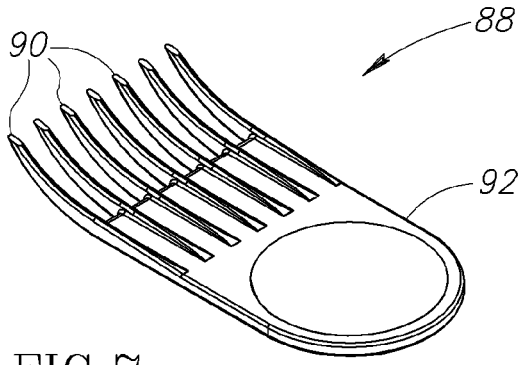
FIG. 7 is a perspective view of a cleaning tool for use with the invention.

Referring to FIG. 7, a cleaning tool 88 including a plurality of tines 90 and a handle 92 may be used to clean the projections 50 and between the blades 40. The tines are sized and spaced apart such that they can pass between the projections 50 and blades 40 to facilitate simultaneous clearing of the gaps between the projections 50 and the blades 40. A user may therefore pass the tines through the projections 50 and blades 40 in order to remove cut items to avoid waste or for cleaning.

While the preferred embodiment of the invention has been illustrated and described, as noted above, many changes can be made without departing from the spirit and scope of the invention.

The embodiments of the invention in which an exclusive property or privilege is claimed are as follows:

1. A food processing device, comprising:

a reservoir having a first upwardly extending sidewall and a second upwardly extending sidewall, each of the first and second upwardly extending sidewalls having a top end and a bottom end;

a tray secured to the reservoir, the tray having a plurality of blades positioned within a blade aperture formed in the tray, each of the plurality of blades having an upper leading edge;

a lid pivotally attached to the device for movement between a first position adjacent the tray and a second position relatively distant from the tray, the lid comprising a plurality of projections sized and configured to be received between the plurality of blades when the lid is adjacent the tray;

a trimming blade secured to the device along a boundary of the blade aperture and configured such that when the lid is pivoted adjacent the tray the trimming blade, lid, and first sidewall are adjacent one another, the trimming blade further having a cutting edge, the cutting edge extending above the upper leading edges of the plurality of blades; and a peripheral flange extending downward from the lid and receiving an outer surface of the reservoir when the lid is pivoted to the first position, the flange defining a cutaway portion adjacent the trimming blade when the lid is pivoted to the first position.

2. The device of claim 1, wherein each of the blades within the plurality of blades is parallel to one another.

3. The device of claim 1, wherein the plurality of blades further comprises a first plurality of parallel blades and a second plurality of parallel blades, the second plurality of parallel blades being generally orthogonal to the first plurality of parallel blades to define a plurality of substantially square openings, and further wherein each of the projections among the plurality of projections is configured to fit within one of the plurality of substantially square openings.

4. The device of claim 1, wherein the tray is removably secured to the reservoir, and further wherein the tray comprises a bore to facilitate removal of the tray from the reservoir.

5. The device of claim 1, wherein the lid is removably attached to the reservoir.

6. The device of claim 1, wherein the trimming blade is secured to the tray and extends upward.

7. The device of claim 1, wherein the device further comprises one or more volumetric indicators.

8. A food processing device, comprising:

a reservoir having upwardly extending sidewalls having a top end and a bottom end, the top end terminating in a rim;

a tray secured to the reservoir and supported by the rim, the tray having a plurality of blades positioned within a blade aperture formed in the tray, each of the plurality of blades having an upper leading edge, the plurality of blades lying substantially in a plane spanning the rim;

a lid pivotally attached to the reservoir for movement between a first position adjacent the tray and a second position relatively distant from the tray, the lid comprising a plurality of projections sized and configured to be received between the plurality of blades when the lid is adjacent the tray;

a trimming blade secured to the tray along a boundary of the blade aperture, the trimming blade further having a cutting edge, the cutting edge extending above the plurality of blades and toward the lid; and a peripheral flange extending downward from the lid and receiving an outer surface of the reservoir when the lid is pivoted to the first position, the flange defining a cutaway portion adjacent the plurality of blades when the lid is pivoted to the first position.

9. The device of claim 8, wherein the cutaway portion is adjacent the trimming blade when the lid is pivoted to the first position.

* * * * *